US011215029B2

(12) United States Patent
Trondsen et al.

(10) Patent No.: US 11,215,029 B2
(45) Date of Patent: Jan. 4, 2022

(54) CEMENTED BARRIER VALVE PROTECTION

(71) Applicant: HALLIBURTON ENERGY SERVICES, INC., Houston, TX (US)

(72) Inventors: Alexander Trondsen, Hafrsfjord (NO); Terje Abrahamsen, Hundvag (NO); Gunnar Lende, Sola (NO)

(73) Assignee: Halliburton Energy Services, Inc., Houston, TX (US)

( * ) Notice: Subject to any disclaimer, the term of this patent is extended or adjusted under 35 U.S.C. 154(b) by 71 days.

(21) Appl. No.: 16/639,477

(22) PCT Filed: Feb. 22, 2019

(86) PCT No.: PCT/US2019/019288
§ 371 (c)(1),
(2) Date: Feb. 14, 2020

(87) PCT Pub. No.: WO2019/165303
PCT Pub. Date: Aug. 29, 2019

(65) Prior Publication Data

US 2021/0131226 A1 May 6, 2021

Related U.S. Application Data

(60) Provisional application No. 62/634,668, filed on Feb. 23, 2018.

(51) Int. Cl.
*E21B 34/14* (2006.01)
*E21B 33/13* (2006.01)

(52) U.S. Cl.
CPC ..... *E21B 34/14* (2013.01); *E21B 33/13* (2013.01)

(58) Field of Classification Search
CPC ..... E21B 34/01; E21B 33/13; E21B 17/10; E21B 34/00; E21B 33/127; E21B 33/1277; E21B 33/1243
See application file for complete search history.

(56) References Cited

U.S. PATENT DOCUMENTS 4,971,152 A 11/1990 Koster et al.
5,718,288 A 2/1998 Bertet et al.
(Continued)

FOREIGN PATENT DOCUMENTS

GB 2490924 B 7/2013
IN 2003/CHE/2008 8/2008
WO WO-2004001183 A1 12/2003

OTHER PUBLICATIONS

Korean Intellectual Property Office, International Search Report and Written Opinion, dated Jun. 5, 2019, 8 pages, Korea.
(Continued)

*Primary Examiner* — Michael R Wills, III
(74) *Attorney, Agent, or Firm* — Haynes and Boone, LLP

(57) ABSTRACT

A downhole tool component may be deployed in a wellbore such that a flexible portion of the tool component is constrained to a first range of motion. By applying a force to the flexible portion, a flexible carrier material applied around the flexible portion of the tool component may be compressed and collapsible objects carried by the carrier material to be collapsed to permit the flexible portion to move through a second range of motion greater than the first range of motion. Cement in the wellbore may constrain movement of the flexible portion, and an elastomeric sheet may be compressed, and glass spheres carried by the elastomeric sheet may be crushed to create voids through which the flexible portion may move. Closure of a barrier valve may be effected by the operation of an actuator assembly that relies
(Continued)

on movement of the flexible portion through the second range of motion.

20 Claims, 9 Drawing Sheets

(56) References Cited

U.S. PATENT DOCUMENTS

| | | | | |
|---|---|---|---|---|
| 5,833,001 | A | 11/1998 | Song et al. | |
| 6,012,522 | A | 1/2000 | Donnelly et al. | |
| 6,431,282 | B1 | 8/2002 | Bosma et al. | |
| 6,722,433 | B2 | 4/2004 | Brothers et al. | |
| 7,748,468 | B2 * | 7/2010 | Casciaro | E21B 33/1208 166/387 |
| 8,256,516 | B2 | 9/2012 | Rodgers | |
| 9,783,622 | B2 | 10/2017 | Brandenburger et al. | |
| 2015/0068774 | A1 * | 3/2015 | Hallundbæk | E21B 33/127 166/387 |
| 2016/0053572 | A1 | 2/2016 | Snoswell | |
| 2017/0183781 | A1 | 6/2017 | Wu et al. | |

OTHER PUBLICATIONS

Trelleborg, Compound 76159, MDS76159, Material Data Sheet, Application Vikotherm TM R2-A insulation material, Feb. 2, 2017, 1 page.

3MGlassLASSBubbles, Intro to 3M™ Glass Bubbles in Plastic Composites, https://www.youtube.com/watch?v=pr7aTn8M7yc.

Halliburton Completion Tools, Swell Technology, Swellpacker® Isolation System Achieve Complete Zonal Isolation, 2018, 2 pages, H07827 Mar. 2018.

IMPI, SIGA, Gaceta De La Propiedad Industrial—Industrial Property of Gazette, MX 265282, May 21, 2009, 3 pages, Mexico.

Government of India—Intellectual Property, Registration Report, IN-261494, 3 Pages, Aug. 18, 2017.

* cited by examiner

CEMENTED BARRIER VALVE PROTECTION

CROSS REFERENCE TO RELATED APPLICATION(S)

This application is a U.S. national stage patent application of International Patent Application No. PCT/US2019/019288, filed on Feb. 22, 2019, which claims priority to U.S. Provisional Application No. 62/634,668 filed Feb. 23, 2018, entitled "Cemented Barrier Valve Protection," the disclosures of which are hereby incorporated by reference in their entireties.

BACKGROUND

Certain tools utilized in downhole wellbore operations require movement of a tool component in order to operate. For example, some downhole tools rely upon "flexing" of an external tool body in order to operate. This may be true of remotely activated tools, e.g., interventionless tools, or downhole tools responsive signals or fluid pressures transmitted from a surface location, where flexing of the tool body is utilized to actuate the tool. Such tools may include an indexing system to actuate the tool. Stored pressure energy necessary to drive the indexing system is stored in the tool by flexing a component of the tool, such as the external body, via hydraulic pressure cycles applied from a wellbore fluid. Often times, the flexing occurs on a microscopic level whereby the tool component only moves a small amount, such as for example, fractions of millimeters. However, such movement is sufficient to actuate the tool for its intended purpose.

Based on the foregoing, it will be appreciated that if the tool component is unable to flex or otherwise move as desired, the tool may not function properly. In this regard, if movement of the tool component is constrained in some way, the tool may not function properly.

For example, a fluid loss isolation barrier valve is one type of downhole tool that may not function properly if constrained. A fluid loss isolation barrier valve is often installed in open hole wellbores to isolate the formation below an uppermost gravel-pack packer, holding pressure from above and below, to help ensure complete formation isolation. Fluid loss isolation barrier valves may be used in sand control frac-pack, gravel-pack, and standalone screen applications as well as intelligent and standard completions, and generally include a valve that can be opened or closed through the use of an indexing system. The indexing system may be driven by flexing of a portion of the external tool body or housing through a cyclical application of internal working fluid pressure. However, in some cases, it might be desirable to deploy the fluid loss isolation barrier valve within a wellbore casing string and cement the valve in place. It will be appreciated that in such case, the cement in which the fluid loss isolation barrier valve is encased prevents flexing of the tool body, and hence, desired operation of the valve.

BRIEF DESCRIPTION OF THE DRAWINGS

The disclosure is described in detail hereinafter, by way of example only, on the basis of examples represented in the accompanying figures, in which.

DETAILED DESCRIPTION

Figure 1:
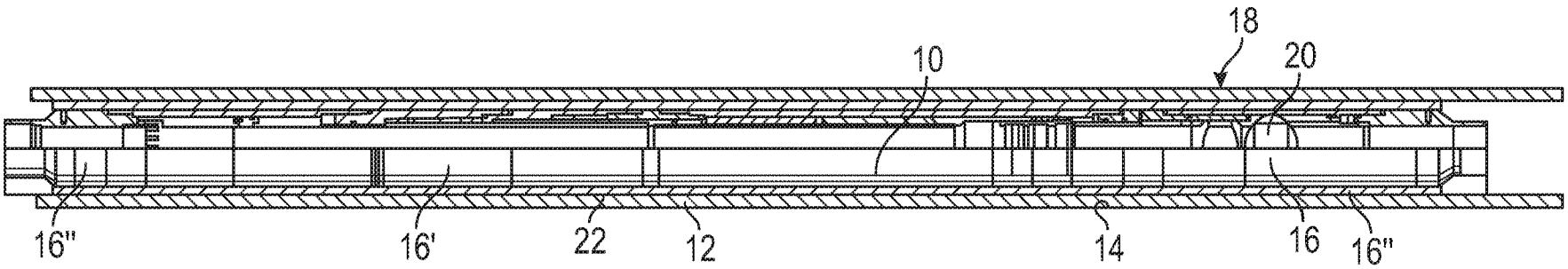
FIG. 1 is a partial cross-sectional side view of an open-hole wellbore system including a downhole tool partially wrapped in a flexible carrier material and encased in cement.

The present disclosure describes a tool component for which movement (such as flexing or radial expansion) is desired be coated, wrapped or otherwise surrounded with a flexible material that would allow for some movement or "flexing" of the component, even when encased in cement. In some embodiments, the tool component may be coated or wrapped with a flexible elastomeric material, such as rubber. In some embodiments, the tool component may be coated or wrapped with a compressible material, such as open cell foam. In some embodiments, the tool component may be coated or wrapped with a flexible carrier material having collapsible or crushable hollow objects, wherein the flexible carrier material may include rubber, foam, a swell able material (as is known in the industry), woven material or fabric, resin, epoxy, plastic, thermoplastic, polyester, silicone, or foamed cement. Hollow objects may include glass spheres that break or plastic spheres that collapse under application of an external force. Hollow objects may also be formed of foamed perzolan material, ceramic, natural pozzolan, natural perlite, or foamed cement among other materials, so long as the hollow object is collapsible, compressible or crushable in order to decrease the volume of the hollow objects upon application of a force. In other words, the hollow objects have a first volume in a first (uncrushed/uncollapsed/uncompressed) state and a second volume that is less than the first volume when the crushable hollow objects are in a second (crushed/collapsed/compressed) state. In some embodiments, the hollow objects may be embedded in the carrier material, such as for example, rubber or foam, or integrated into the weave of a material, such as woven fabric. The flexible carrier material is disposed around the tool component. When an external force is applied to the flexible material, the hollow objects crush or break, leaving voids that permit flexing or movement of the tool component. Thus, the crushable objects may be glass spheres that can be broken under application of appropriate force.

For ease of description, the term "crushable" will hereafter be used to refer to any hollow object that may be crushed, compressed, collapsed or otherwise reduced in volume under application of a force. Likewise, the term "carrier material" will be used to refer to any flexible material, including the aforementioned rubber, foam, a swellable material (as is known in the industry), woven material or fabric, resin, epoxy, plastic, thermoplastic, polyester, silicone, or foamed cement, that can be utilized as a platform for carrying the crushable objects. Such object may be deployed on or in the carrier material, such as for example, by embedding the objects in the carrier material or weaving or otherwise attaching the objects to the material. In some embodiments, the crushable objects may be deployed in a uniform matrix, while in other embodiments, the crushable objects may be randomly deployed. Without limiting the disclosure, in some embodiments, crushable objects may be approximately 50% by volume of flexible carrier material, while in other embodiments, the volume may be greater or less as determined for the particular movable component with which they are deployed. Without limiting the disclosure, in some embodiments, crushable objects may be approximately 10-85 microns in diameter, while in other embodiments, the crushable objects may be larger or smaller in size as determined for the particular movable component with which they are deployed. In some embodiments, the crushable objects may be density reducing objects utilized in drilling fluids and drilling cements commonly used in wellbores.

It should be noted that while the crushable objects are described in some embodiments as spheres, the objects may be of any shape so long as they include a hollow space or void formed therein. For example, the hollow objects may be oval, square, triangular, or polygonal in shape. Likewise, the hollow objects are described primarily of being formed of glass, but may be formed of any material that would allow the object to be crushed thereby permitting a void to form in the carrier material, such as plastic, those other materials identified herein or other material.

Moreover, in certain embodiments, the crushable object may simply contain air in the to hollow space, while in other embodiments, the objects may contain one or more other fluids that could interact with the carrier material to further the goal of creating clearance around the tool component to allow movement. More specifically, the crushable object may include a liquid or gas or both which fluids interact with a carrier material to cause the carrier material to degrade, creating a void between the tool component and the cement in which it is encased. For example, the crushable objects may include a fluid that when exposed to rubber as the underlying carrier material causes the rubber to degrade.

In some embodiments, the elastomeric material, carrier material or flexible material may be provided in the form of a sheet that can wrap or otherwise be deployed around the tool component. For example, it the tool component is the external body of a tool, the tool body may be wrapped in a sheet of carrier material.

With reference to FIG. 1, a downhole tool 10 is provided. In some embodiments, tool 10 is a fluid loss isolation barrier valve tool. Tool 10 is illustrated encased in cement 12 within a wellbore 14. Tool 10 includes an elongated housing or tool body 16 and may include various tool components 18, such as a valve 20. Housing or tool body 16 is at least partially coated, bound or wrapped in a flexible carrier material 22. The tool body 16 may be constructed as an elongated cylindrical wall having a flexible portion 16' bounded by ridged portions 16" on axial sides of the flexible portion 16'. The flexible portion 16' of the housing wall is radially movable with respect to the rigid portions 16" under application of a radial force, e.g., a force generated by changing a hydraulic pressure on an interior of the tool body 16.

In operation, the tool 10 having a flexible carder material 22 disposed around at least a portion of the tool body 16 is deployed in a wellbore 14 and cemented in place utilizing cement 12. Thereafter, hydraulic pressure is applied to the tool body 16 to cause a portion of the tool body 16 to flex, e.g., to cause the flexible portion 16' to radially expand or contract, under the application of the hydraulic pressure. The flexing of the tool body 16 results in compression of the flexible carrier material 22 adjacent the flexible portion 16' of the tool body 16. To the extent crushable or collapsible objects 305 (see FIG. 4) are embedded or otherwise carried in or by the flexible carrier material 22, the crushing or collapsing the objects reduces their volume, thereby creating an open space or a void adjacent the tool body 16. The tool body 16 can then be flexed, as described above, into the open space thereby allowing the tool 10 to be manipulated by flexing for its intended operation. In the case of the fluid loss isolation barrier valve tool 10, once the collapsible objects 305 are reduced in volume to create the open space, the tool body 16 can be flexed via pressure cycles, thereby permitting radial movement of at least a portion of the tool body 16 in order to actuate and drive the indexing system, which in turn, is utilized to actuate a tool element 18, such as opening or closing valve 20. In other words, the flexible carrier material 22 and crushable objects 305 may be hollow to allow voids to be formed into which the movement of the tool body 16 can be absorbed. Thus, the degree of movement of the flexible portion 16' is limited by the flexible carrier material 22 when the collapsible objects 305 are in a first (uncrushed/uncollapsed) state and the degree of movement of the flexible portion 16' is increased when the collapsible objects 305 are in a second (crushed/collapsed) state. In this way, fluid loss isolation barrier valve tool 10 can be utilized in cemented operations such as described above.

It should be noted that the forgoing arrangement is particularly desirable because it maintains the sealing integrity of the cement 12 around the tool 10, while at the same time permitting operation of the tool 10 through the indexing system. Specifically, only a portion, e.g., the flexible portion 16', of the tool body 16 is flexed in order to actuate the valve 20. Thus, the flexible carrier material 22 above and below the area of flexure functions to maintain the seal with the cement 12.

While the flexible material 22 may be employed with tools permanently cemented in place, e.g., the tool 200 (FIG. 3B) described below, in other methods, the flexible carrier material 22 may be utilized to extract a tool 10 that is cemented into place. Specifically, a tool 10 may be cemented in place and utilized in various downhole operations. After the operations are complete and it is desired to remove the tool, hydraulic fluid may be utilized to flex tool body 16, crushing or otherwise collapsing the objects 305 a sufficient degree that the tool 10 becomes loose within cement 12, allowing tool 10 to be withdrawn from wellbore 14.

Figure 2:
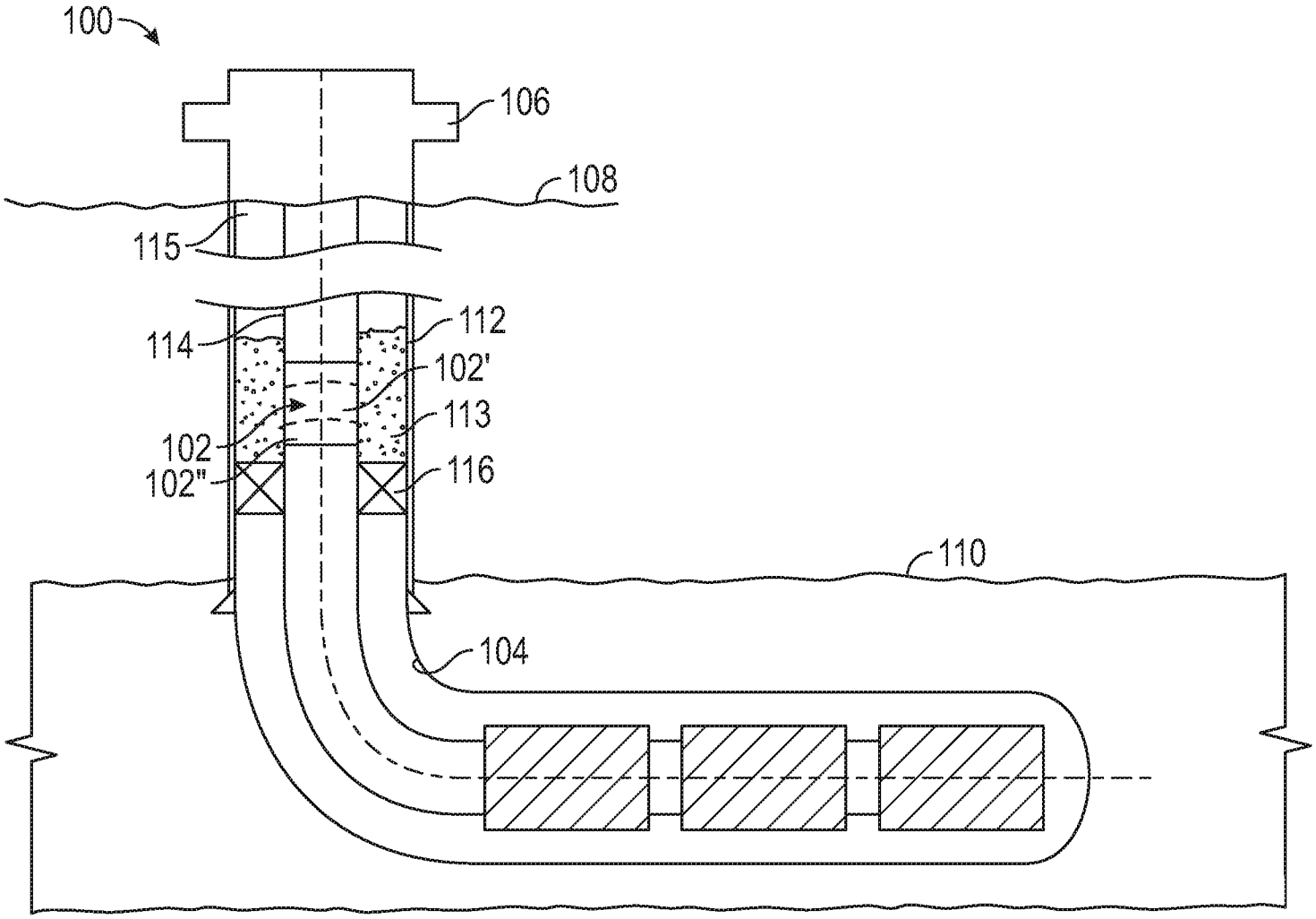
FIG. 2 is a cross-sectional side view of a partially cased wellbore system including a downhole tool having flexible and rigid portions cemented in place within a casing string.

FIG. 2 is a side cross-sectional view of a wellbore system 100 with tool 102 constructed in accordance with the concepts herein. The wellbore system 100 is provided for convenience of reference only, and it should be appreciated that the concepts herein are applicable to a number of different configurations of well systems. As shown, the wellbore system 100 includes a substantially cylindrical wellbore 104 that extends from well head 106 at a terranean surface 108 through one or more subterranean zones of interest, such as subterranean zone 110. In FIG. 2, the wellbore 104 extends substantially vertically from the terranean surface 108 and deviates to horizontal in the subterranean zone 110. However, in other instances, the wellbore 104 can be of another configuration, for example, entirely substantially vertical or slanted, it can deviate in another manner than horizontal, it can be a multi-lateral, and/or it can be of another configuration.

The wellbore 104 is lined with a casing 112, constructed of one or more lengths of tubing, that extends from the well head 106 at the surface 108, downhole, toward the bottom of the well 104. The casing 112 provides radial support to the wellbore 104 and seals against unwanted communication of fluids between the wellbore 104 and surrounding formations. Here, the casing 112 ceases or terminates at the subterranean zone 110 and the remainder of the wellbore 104 is an open hole, i.e., encased. In other instances, the casing 112 can extend to the bottom of the wellbore 104 or can be provided in another configuration.

A completion string 114 of tubing and other components is coupled to the well head 106 and extends, through the wellbore 104, downhole, into the subterranean zone 110. The completion string 114 is the tubing that is used, once the well is brought onto production, to produce fluids from and inject fluids into the subterranean zone 110. Prior to bringing the well onto production, the completion string 114 is used to perform the final steps in constructing the wellbore 104. The completion string 114 is shown with a packer 116 above the subterranean zone 110 that seals an annulus 115 between the completion string 114 and casing 112, and directs fluids to flow through the upper portion of the completion string 114 rather than the annulus 115.

The tool 102 is provided in the completion string 114 and may be cemented within the casing 112, either above or below the packer 116, utilizing cement 113 deployed in annulus 115. Tool 102 may include a flexible portion 102' and one or more rigid portions 102" the operation of which will be explained below. The tool 102 when open, allows passage of fluid and communication of pressure through the completion string 114. When closed, the tool 102 seals against passage of fluid and communication of pressure between the lower portion of the completion string 114 below the tool 102 and the upper portion of the completion string 114. The tool 102 has provisions for both mechanical and remote operation. As described in more detail below, for mechanical operation, the tool 102 has an internal profile that can be engaged by a shifting tool to operate the valve 20 (FIG. 1). For remote operation, the tool 102 has a remote actuator assembly 220 (FIG. 3A) that responds to a signal (e.g., a hydraulic, electric, and/or other signal) to operate the valve 20. As described below, a hydraulic signal may be employed, which may cause the flexible portion 102' to flex appropriately. The signal can be generated remotely with respect to the tool 102, for example at the terranean surface 108.

In the depicted example, the tool 102 is shown as a fluid isolation valve that is run into the wellbore 104 open, mechanically closed with a shifting tool (not shown) and then eventually re-opened in response to a remotely generated signal. The tool 102, thus allows an operator to fluidically isolate the subterranean zone 110, for example, while an upper portion of the completion string 114 is being constructed, while subterranean zones above the tool 102 are being produced (e.g., in a multi-lateral well), and for other reasons. The concepts herein, however, are applicable to other configurations of valves. For example, the tool 102 could be configured as a safety valve. A safety valve is typically placed in the completion string 114 or riser (not shown), e.g., in a subsea well, and may be biased to a closed configuration and held open by a continuing remote signal. When the remote signal is ceased, for example, due to failure of the well system above the tool 102, the tool 102 closes. Thereafter, the tool 102 is mechanically re-opened to recommence operation of the well.

Figure 3A:
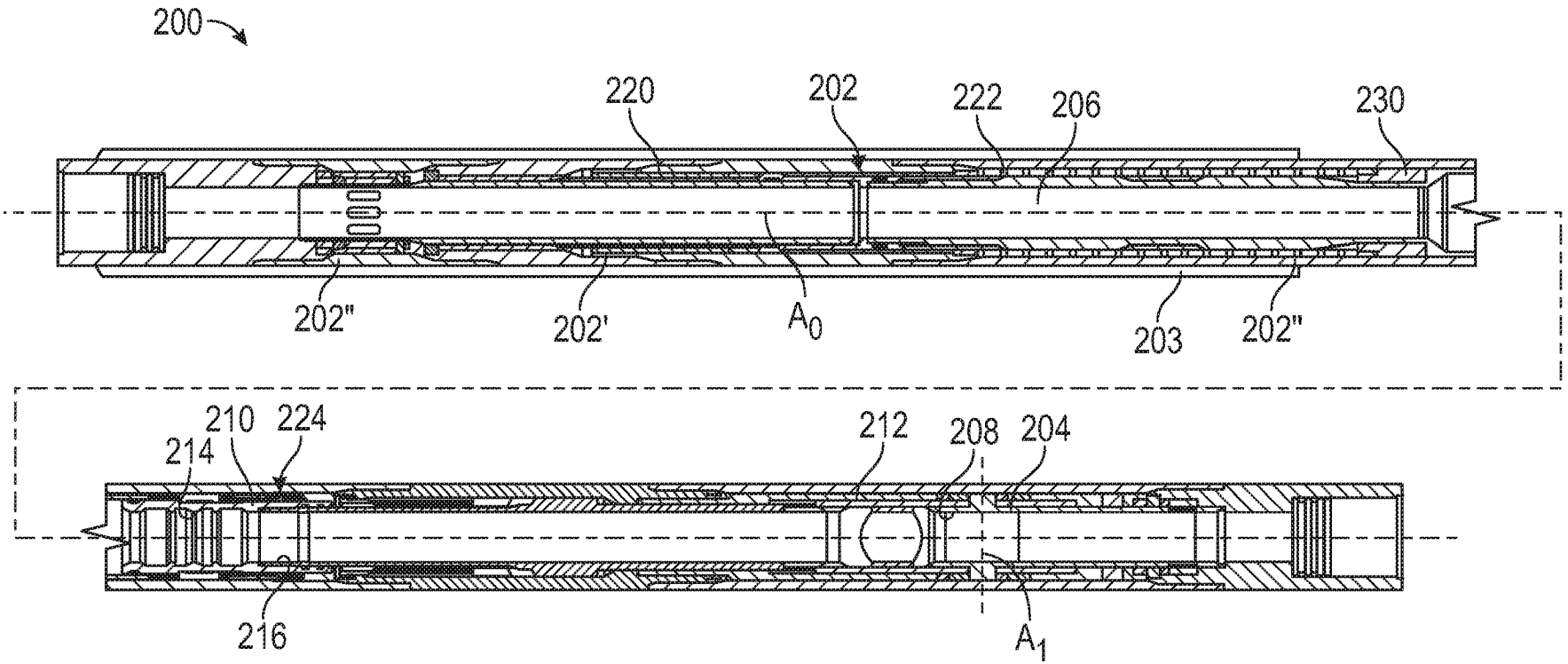
FIGS. 3A and 3B are cross-sectional side views of downhole valve tool having an actuator assembly in respective actuated (open) and unactuated (closed) configurations.
Figure 3B:
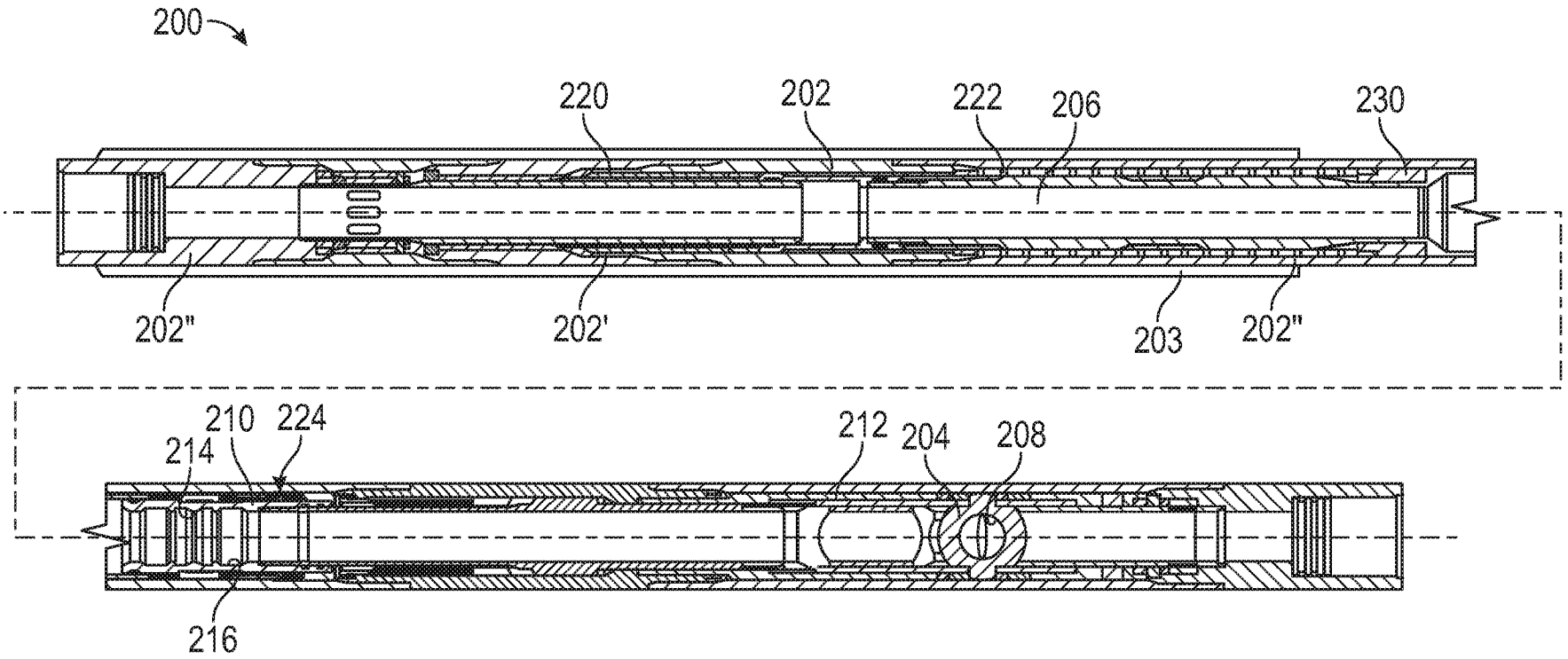

FIGS. 3A and 3B are detail side cross-sectional views of an example tool 200 in the form of a valve. FIG. 3A shows the example valve tool 200 in an open configuration (actuated), and FIG. 3B shows the example valve tool 200 in a closed (unactuated) configuration. The example tool 200 can be used as tool 102 in the wellbore system 100 (FIG. 2). The tool 200 includes an elongate, tubular housing 202 that extends the length of the tool 200. The housing 202 is shown as made up of multiple parts for convenience of construction, and in other instances, could be made of fewer or more parts. The ends of the housing 202 are configured to couple to other components of the completion string 114 (FIG. 2), e.g., threadingly and/or otherwise. Housing 202 includes a flexible portion 202' and one or more rigid portions 202". In the illustrated embodiment, flexible portion 202' is bounded by rigid portions 202". It will be appreciated that as used herein, flexible portion 202' refers to a portion of the housing 202 that can have some flexure or radial movement with respect to a longitudinal central axis $A_0$ under application of internal fluid pressure, allowing for actuation of actuator assembly 220 described below. In any event, the components of the tool 200 define an internal, cylindrical central bore 206 that extends the length of the tool 200. The central bore 206 is the largest bore through the tool 200 and corresponds in size to a central bore of the remainder of the completion string 114. The housing 202 contains a spherical ball-type valve closure 204 that, likewise, has a cylindrical, central bore 208 that is part of and is the same size as the remainder of the central bore 206. The valve closure 204 is carried to rotate about an axis $A_1$ transverse to the longitudinal axis of the housing 202. The tool 200 is open when the central bore 208 of the valve closure 204 aligns with and coincides with the central bore 206 of the remainder of the tool 200 (FIG. 3A). The tool 200 is closed when the central bore 208 of the valve closure 204 does not coincide with, and seals against passage of fluid and pressure through, the central bore 206 of the remainder of the tool 200 (FIG. 3B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (to the left in FIG. 3B) and a downhole position (to the right in FIG. 3A), and correspondingly move the valve fork 212 between an uphole position and a downhole position. When the actuator sleeve 210 (and valve fork 212) are in the uphole position, the valve closure 204 is in the closed position. As the actuator sleeve 210 (and valve fork 212) translates to the downhole position, the valve closure 204 rotates around the transverse axis to the open position.

The tool 200 has provisions for interventionless or remote operation to operate the valve closure 204 in response to remote signal (e.g., a hydraulic, electric, and/or other signal). To this end, the tool 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the tool 200 configured as a fluid isolation valve, the actuator assembly 220 is responsive to a specified number of pressure cycles (increase and decrease) provided in the central bore 208. In preferred embodiments, flexible portion 202' of housing 202 is adjacent actuator assembly 220 so that flexure of the flexible portion 202' actuates actuator assembly 220. In this regard, flexible portion 202' may be flexed radially inward and outward, even if only by millimeters or fractions of millimeters, but of sufficient movement to cooperate with actuator assembly 220. When actuated, actuator assembly 220 releases compressed power spring 222 carried in the housing 202 and coupled to the actuator sleeve 210. FIG. 3A shows the actuator assembly 220 in an unactauted state with the power spring 222 compressed. FIG. 3B shows the actuator assembly 220 in the actuated state with the power spring 222 expanded. As seen in the figure, the released power spring 222 expands, applies load to and moves the actuator sleeve 210 axially from the uphole position to the downhole position, and thus changes the valve closure 204 from the closed position (FIG. 3B) to the open position (FIG. 3A). In some implementations, a stop spring mandrel 230 carried with the power spring 222 outputs the actuation loads and axial movement from the actuator assembly 220 (i.e., outputs the force and movement of the power spring 222). The pressure cycles are a remote signal in that they are generated remotely from the tool 200, for example, by repeatedly opening and closing a valve in the completion string at the surface, for example, in the well head.

Shown deployed around at least a portion of tool housing 202 is flexible material 203. In preferred embodiments, flexible material 203 is adjacent at least the flexible portion 202' of housing 202, but may extend so as to overlay one or more rigid portions 202" of housing 202 as well. Flexible material 203 may be any material that is flexible and/or compressible, including without limitation, rubber, open cell foam, a swellable material, a woven material or fabric.

The tool 200 has provisions for mechanical operation to allow operating the valve closure 204 with a shifting tool (not shown) inserted through the central bore 206. To this end, the actuator sleeve 210 has a profile 214 on its interior bore 216 that is configured to be engaged by a corresponding profile of the shifting tool. The profile 214 enables the shifting tool to grip the actuator sleeve 210 and move it between the uphole position and the downhole position, thus operating the valve closure 204. In the present example, the uphole position corresponds to the valve closure 204 being in the fully closed position and the downhole position corresponds to the valve closure 204 being the fully open position. The shifting tool can be inserted into the tool 200 on a working string of tubing and other components inserted through the completion string 114 (FIG. 2) from the terranean surface 108

To facilitate mechanical operation of the tool 200 when the actuator assembly 220 has been actuated, the actuator sleeve 210 can be uncoupled from the remote actuator assembly 220. Uncoupling the actuator sleeve 210 from the remote actuator assembly 220 reduces the amount of force the shifting tool must apply to move the actuator sleeve 210. For example, in a configuration having a power spring 222, if the actuator sleeve 210 is uncoupled from the remote actuator assembly 220, the shifting tool does not have to compress the power spring 222. Thus, the remote actuator assembly 220 is releasably coupled to the actuator sleeve 210 via a releasable coupling assembly 224. In some implementations, one or more collets, e.g., collet ring 304 (see FIG. 4), in the housing 202 are supported to couple the actuator sleeve 210 and the actuator assembly 220 while the actuator assembly 220 changes from the unactuated state to the actuated state. When the actuator assembly 220 reaches the actuated state, the collet is unsupported to uncouple the actuator assembly 220 and actuator sleeve 210 and allow the actuator sleeve 210 to move relative to the actuator assembly 220.

Additionally, in certain instances, the interface between the actuator assembly 220 and the actuator sleeve 210 can be configured to allow mechanical operation of the tool 200 when the actuator assembly 220 is in the unactuated state, prior to actuation. In one example, the releasable coupling assembly 224 can couple to the actuator sleeve 210 in a manner that, with the actuator assembly 220 in the unactuated state and the collet supported to couple the actuator sleeve 210 to the actuator assembly 220, the actuator sleeve 210 is able to move between the uphole position and the downhole position, thus opening and closing the valve closure 204.

The tool 200 can thus be installed in the wellbore 104 (FIG. 2) and operated manually, with a shifting tool, to open and close multiple times, and as many times as is needed. Thereafter, the tool 200 can be left in a closed state and remotely operated to an open state via a remote signal. After being opened by the remote signal, the tool 200 can again be operated manually, with a shifting tool, to open and close multiple times, as many times as is needed.

Figure 4:
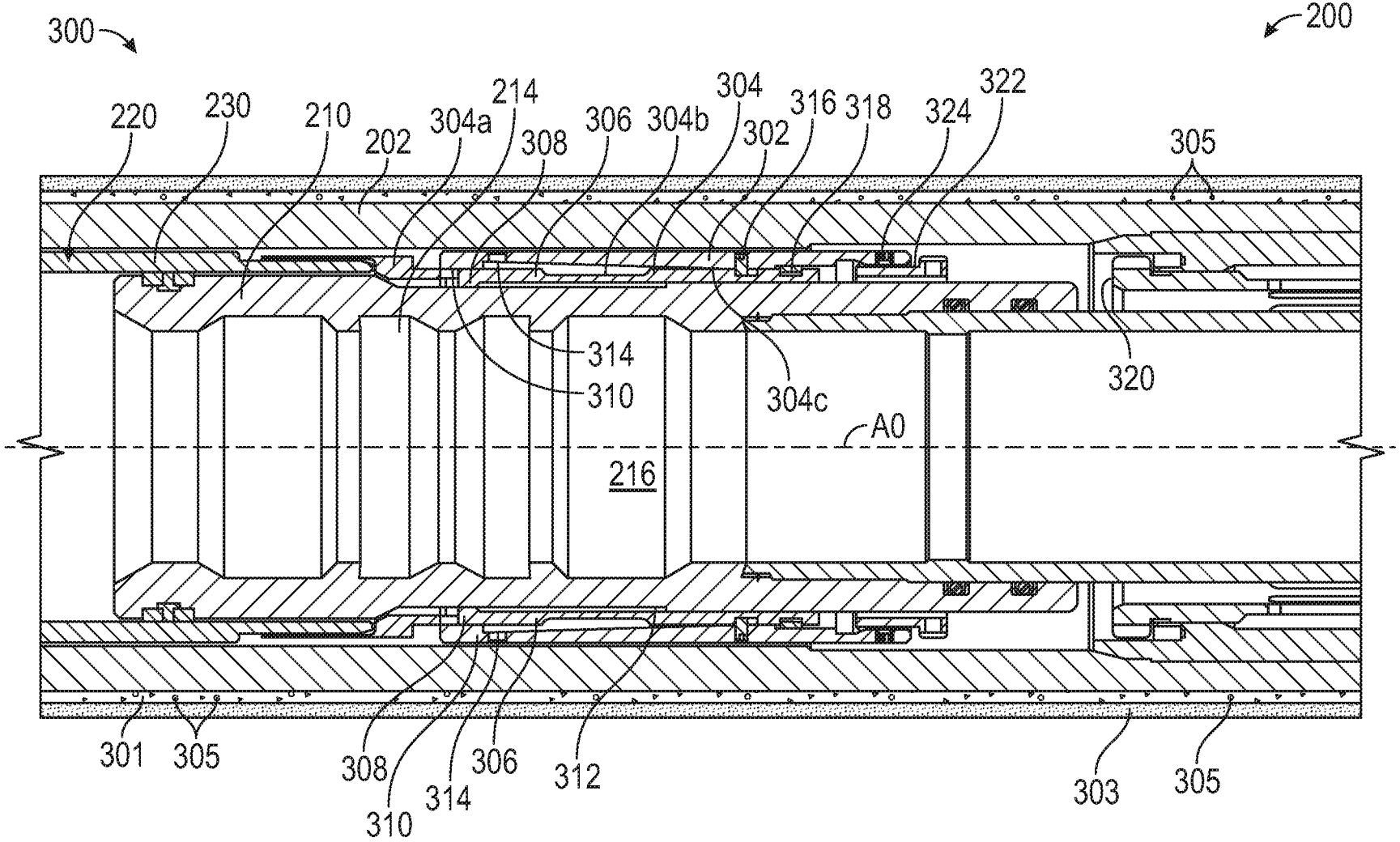
FIG. 4 is an enlarged view of a portion of the downhole valve tool of FIGS. 3A and 3B including a releasable coupling assembly that operably couples an actuator sleeve to a power spring.
Figure 5A:
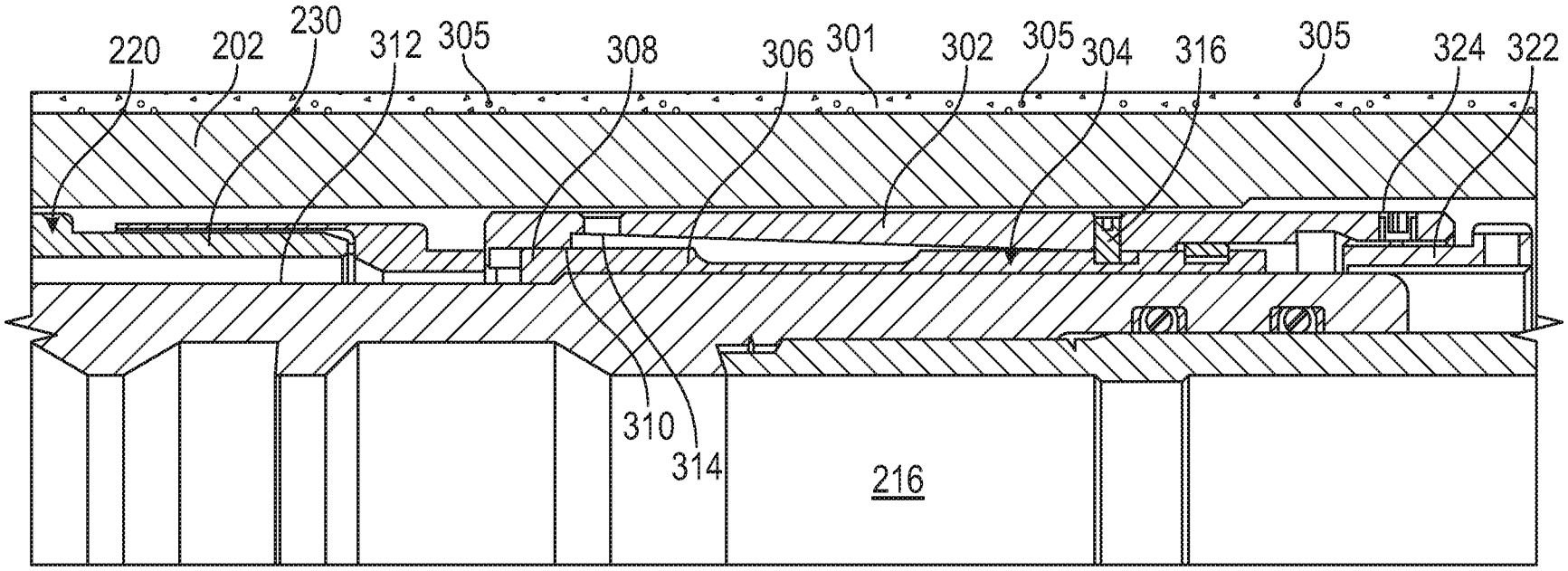
FIGS. 5A and 5B are partial cross-sectional side views of the releasable coupling assembly in respective coupled and decoupled configurations.
Figure 5B:
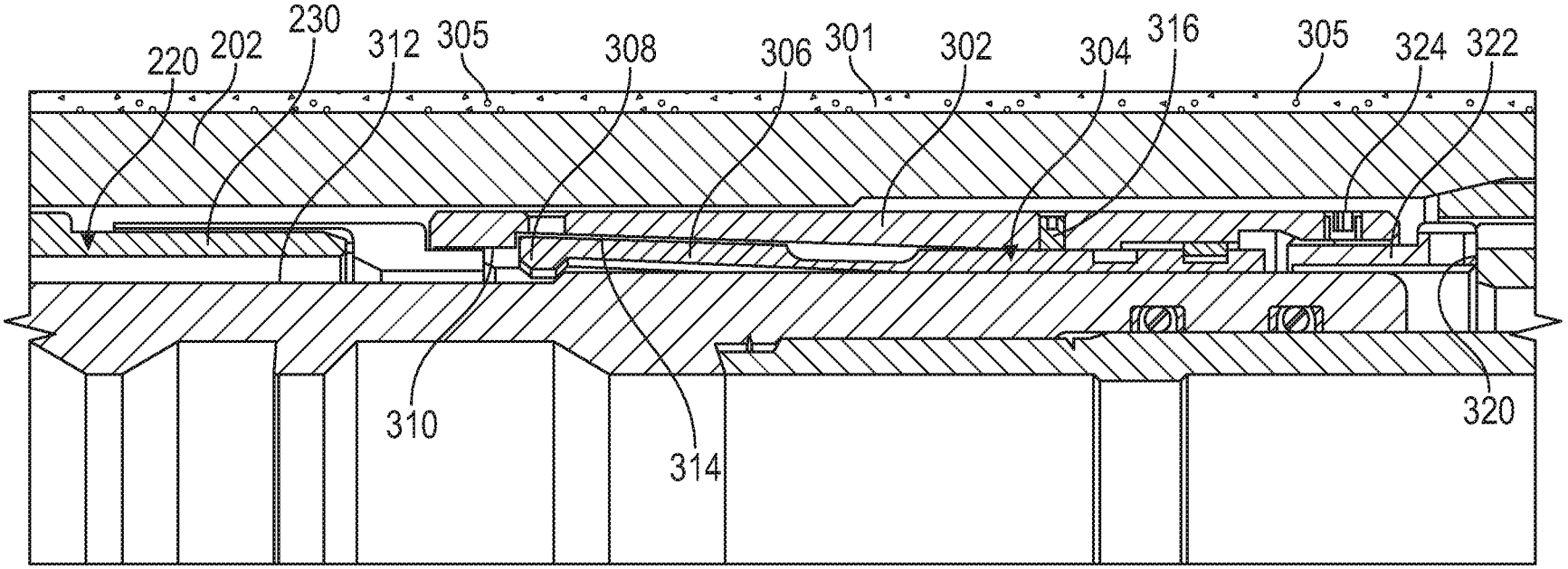

FIGS. 4, 5A and 5B are partial detailed views of a portion of tool 200 including a example releasable coupling assembly 300. FIG. 4 is a half cross-sectional view with the actuator assembly 200 of the tool 200 unactuated and the valve closure 204 open. FIG. 5A is a quarter sectional view showing the actuator assembly 200 changing from an unactuated to an actuated state. FIG. 5B is a quarter sectional view showing the actuator assembly 200 in the actuated state.

Referring now to FIGS. 4 and 5A, and 5B, the portion of tool 200 including the releasable coupling assembly 300 is shown coated or wrapped with a carrier material 301 and encased in cement 303. Carrier material 301 may be flexible and includes collapsible objects 305 carried by the carrier material 301. Collapsible objects 305 may be hollow and crushable or collapsible such that their volume may be reduced upon application of force. Collapsible objects 305 may be embedded within carrier material 301, attached to carrier material 301 or integrally formed in carrier material 301, such as bubbles or cells formed within carrier material 301. Collapsible objects 305 may be glass spheres or shapes that can be crushed upon application of a sufficient force. Collapsible objects 305 may be plastic spheres or shapes that can be collapsed upon application of force. Collapsible objects 305 may include one or more fluids (not shown) within their hollow interior which fluid(s) will cause degradation of carrier material 301 upon contact with the fluid.

In any event, the example releasable coupling assembly 300 can be used as releasable coupling assembly 224 (FIG. 3A) in the tool 200, and is shown in such context in cement 303. FIG. 4 is a detail of the tool 200 in half cross-section with the releasable coupling assembly 300 incorporated therein. FIGS. 3A and 3B depict the tool 200 with the actuator assembly 220 in an actuated and unactuated state and the releasable coupling assembly 300 ready to couple the actuator sleeve 210 to the actuator assembly 220. FIG. 5A is a quarter section detail view showing the actuator assembly 220 changing to the actuated state and the releasable coupling assembly 300 coupling the actuator sleeve 210 to the actuator assembly. FIG. 5B is a quarter section 5 detail view showing the actuator assembly 220 in the actuated state and the coupling assembly 300 released such that the actuator sleeve coupling the actuator sleeve 210 to the actuator assembly 220 are decoupled.

As seen in FIG. 4, the releasable coupling assembly 300 includes a tubular support body 302 that is received within the housing 202 of the valve. The support body 302 internally receives a collet ring 304 that, itself, is received over the actuator sleeve 210. The collet ring 304 is affixed to the spring stop mandrel 230 of the actuator assembly 220 such that the collet ring 304 and the spring stop mandrel 230 move axially together. In certain instances, the end 304*a* (please confirm that the reference numeral 304*a* is correctly placed in FIG. 4. The collet ring 304 seems to be shown in 2 pieces, and without a label for the end 304*a*, the drawing might be confusing) of the collet ring 304 is axially slotted and provided with ratchet threads or teeth biased to allow the end of the collet ring 304 to more deeply receive the spring stop mandrel 230 when the components are pushed axially together, yet still grip and still be threaded to allow the components to thread/unthread. Other manners of the fixing the collet ring 304 and spring stop mandrel 230 are within the concepts described herein.

The collet ring 304 includes a plurality of collet fingers 306 equally spaced around the collet ring 304. Each collet finger 306 has an enlarged head 308 and has a thinner section 304*b* where the finger 306 meets a remainder 304*c* of the collet ring 304. The thinner section 304*b* allows the collet fingers 306 to flex radially outwardly with respect to a plane of the remainder 304*c* of the collet ring 304. The support body 302 has a support portion 310 that when radially over the enlarged heads 308 (as illustrated in FIG. 4), abuts and supports the collet fingers 306 radially inward with the heads 308 engaged in an axially elongate profile 312 of the actuator sleeve 210. The axially elongate profile 312 can be single profile that spans the circumference of the actuator sleeve 210 or a plurality of grooves spaced around the circumference of the sleeve 210, and in certain instances, that correspond in number to the collet fingers 306. The support body 302 has a relief 314 adjacent to and having a larger internal diameter than the support portion 310. When the relief 314 is radially over the enlarged heads 308 (as illustrated in FIG. 5B), the collet fingers 306 are not supported radially inward and are allowed to flex radially outward. As discussed in more detail below, when the collet fingers 306 are unsupported they are able to disengage from the axially elongate profile 312. Although initially coupled with shear pin 316 (e.g., a rod, screw, or other coupling configured to release or break at a specified application of force) to the collet ring 304, once the shear pin 316 is released, the support body 302 is moveable between supporting the collet fingers 306 engaged in the axially elongate profile 312 and not supporting the collet finger 306 engaged in the axially elongate profile 312.

In an example operational procedure, tool 200 is run into position in the wellbore 104 (FIG. 2) and cemented in place, as in FIG. 4, with the actuator assembly 220 in an unactuated state (e.g., the unactuated closed state illustrated in FIG. 3B). The support body 302 is affixed to the collet ring 304 by the shear pins 316 with the support portion 310 supporting the collet fingers 306 engaged in the axially elongate profile 312. In certain instances, the valve closure 204 can be fully open. To actuate, a drilling fluid (not shown) is pumped down interior bore 216 to apply pressure to housing 202, causing housing 202 to flex radially outward. As housing 202 flexes outward, the collapsible objects 305 carried by carrier material 301 are crushed, reducing their volume and creating additional free space into which the housing 202 can flex. To the extent the carrier material 301 is compressible, such as embodiments wherein the carrier material is rubber, compression of the carrier material 301 will likewise create additional free space for flexure of housing 202. In some embodiments, crushable hollow objects 305 may be integrally formed in carrier material 301. For example, in some embodiments, bubbles or cells may be formed in carrier material 301, such as would be the case if carrier material 301 is an open or closed cell foam. In any event, flexure of the housing 202 results in actuation of the actuator assembly 220. When the actuator assembly 220 responds to a remote signal to actuate, the power spring 222 (FIGS. 3A and 3B) drives the spring stop mandrel 230, collet ring 304 and support body 302, downhole to an actuated state. As the actuator assembly 220 changes to the actuated state, as shown in FIG. 5A, the enlarged heads 308 of the collet fingers 306 move (if they are not already) downhole to abut the downhole end of the axially elongate profile 312. Because the collet fingers 306 are supported by the support body 302 with their enlarged heads 308 engaged in the axially elongate profile 312, all (substantially or entirely) of the axial force from the actuator assembly 220 to the actuator sleeve 210 is transferred through the interface of the enlarged heads 308 and the end of the axially elongate profile 312. Thus, neither the shear pins 316 nor the support body 302 are substantially subjected to the axial force, and thus these components do not need to be sized to carry such high forces. The actuator sleeve 210 continues to move downhole with the spring stop mandrel 230, collet ring 304 and support body 302 until the valve closure 204 is moved to the fully open position (as illustrated, e.g., in the actuated state of FIG. 3A).

As the valve closure 204 reaches the fully open position, a downhole end of the support body 302 collides with a shoulder 320 in the housing 202 (FIG. 5B). The shoulder 320 is positioned to hold the support body 302 while the collet ring 304 (driven by the power spring via the spring stop mandrel 230) continues to move downhole to a position with the enlarged heads 308 of the collet fingers 306 apart from the support portion 310 of the support body 302 and beneath the relief 314. In certain instances, the support body 302 includes an adjuster 322 that is positionable to adjust the axial position of the end of the support body 302. The adjuster 322 allows the position at which the shoulder 320 holds the support body 302 to be adjusted. In FIGS. 4, 5A and 5B, the adjuster 322 is depicted as a sleeve threaded to the remainder of the support body 302 to thus be threaded in and out for adjustment of an axial length of the support body 302. However, other configurations could be implemented, for example, using shims, adjustment bolts, and/or other adjustment configurations. Alternately or additionally, the adjuster 322 could be provided on the shoulder 320. In certain instances, the adjuster 322 may have a lock 324 (shown as a set screw, but other locking mechanisms could be used) to more securely affix its position.

With the end of the support body 302 abutting the shoulder 320, the collet ring 304 continues to move downhole, shears the shear pins 316 and releases the support body 302 from the collet ring 304. With the enlarged heads 308 of the collet fingers 306 beneath or within the relief 314, the collet fingers 306 are not radially supported and are allowed to flex radially outward and out of the axially elongate profile 312. Thereafter, a shifting tool can be run into the interior of the tool 200 and engage the internal profile of the actuator sleeve 210 to operate the sleeve 210, and thereby the valve closure 204, manually. The shifting tool can freely move the actuator sleeve 210 to its uphole and downhole positions, thus opening and closing the valve closure 204, as many times as is desired. Because the collet fingers 306 are not radially supported by the support body 302, they will flex outward to allow the enlarged heads 308 to exit and disengage from the axially elongate profile 312 as the actuator sleeve 210 is moved.

Notably, prior to actuating the actuator assembly 220 and with the actuator assembly 220 in the unactuated state, the valve closure 204 can be opened and closed manually with a shifting tool. The axially elongate profile 312 has a length that allows the actuator sleeve 210 to move between its uphole and downhole positions while the collet fingers 306 are engaged in the profile 312. For example, FIG. 4 shows the actuator sleeve 210 in its downhole position (e.g., corresponding to the valve closure 204 open), with the enlarged heads 308 of the collet fingers 306 intermediate (e.g., axially midway along) the axially elongate profile 320. The actuator sleeve 210 can be moved to its uphole position (e.g., corresponding to the valve closure 204 closed) without releasing the collet fingers 306 from the profile 312. Thus, the shifting tool can freely move the actuator sleeve 210 to its uphole and downhole positions, opening and closing the valve closure 204, as many times as is desired.

It will further be appreciated that the foregoing as described only creates "free space" for radial flexure of the housing 202 about that portion of housing 202 that can be flexed (e.g., flexible portion 202' (FIG. 3A)). Thus, carrier material 301 about portions of housing 202 that remain rigid (e.g., rigid portions 202" (FIG. 3A)) will not compress or otherwise flex in order to crush collapsible objects 305 adjacent thereto. As such, carrier material 301 about those rigid portions of the tool maintains the seal between the housing 202 and the surrounding cement 303.

Figure 6A:
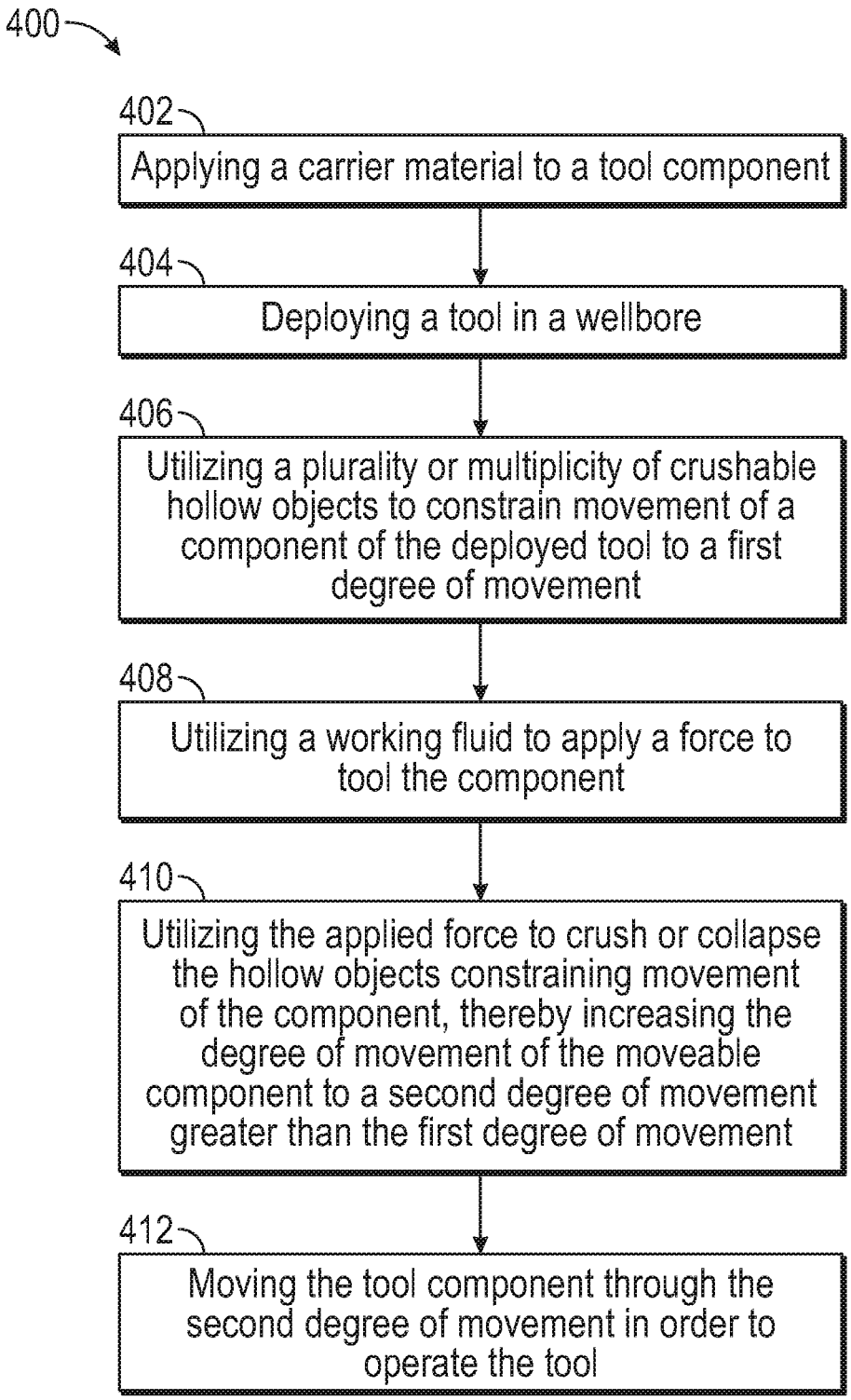
FIGS. 6A and 6B are diagrammatic views illustrating operational procedures employing a generalized downhole tool and a barrier valve tool, respectively.
Figure 6B:
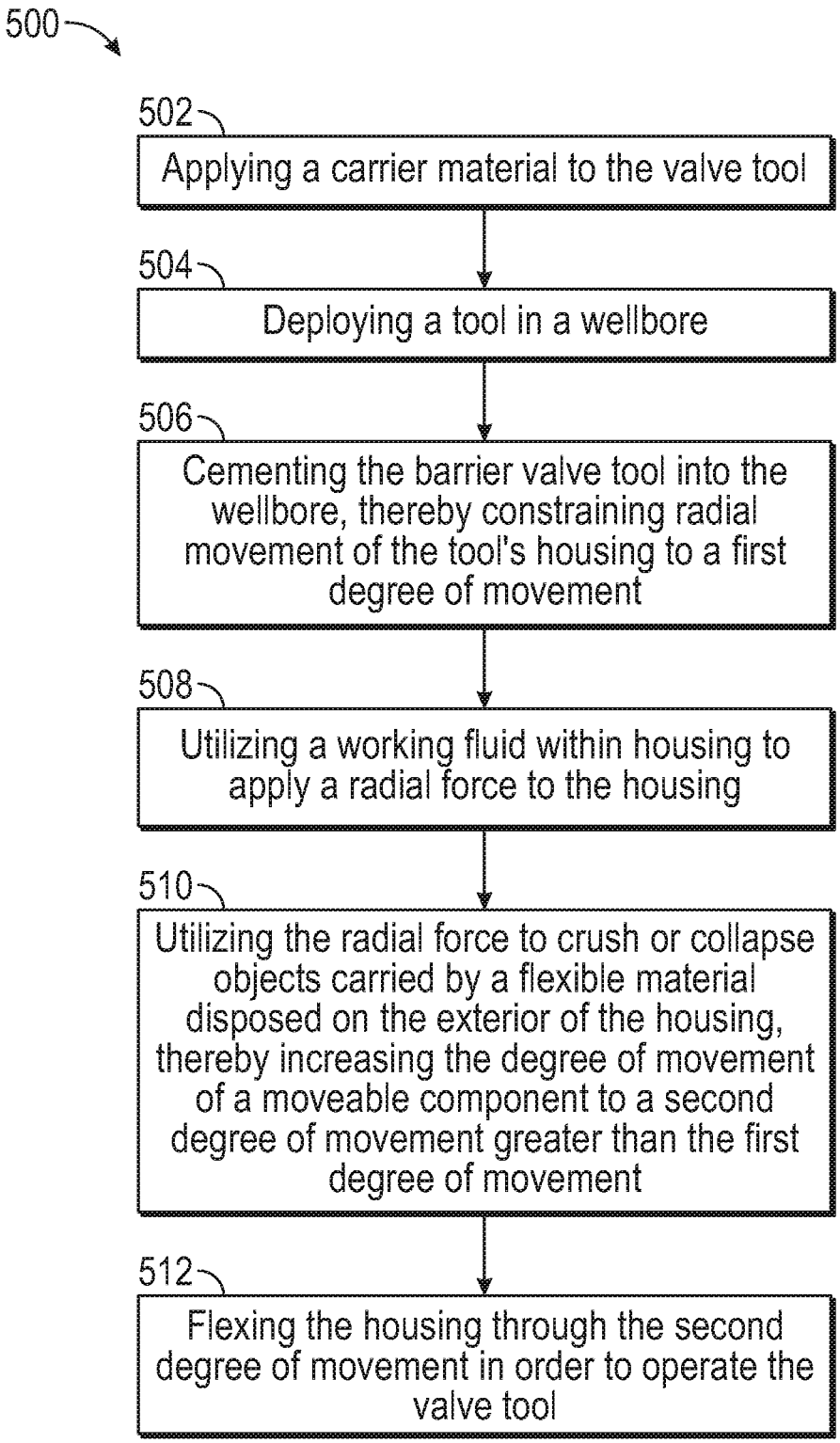

FIGS. 6A and 6B illustrate operational procedures 400, 500 for use of the above described tool 102 (FIG. 2) in operation, wherein FIG. 6A describes deployment and operation of a general tool 102 utilizing a flexible carrier material 301 carrying crushable collapsible objects 305 on a movable tool component, while FIG. 6B describes deployment and operation of a barrier valve tool 200. In operation, a flexible carrier material 301 carrying crushable collapsible objects 305 may be applied to a tool component disposed for radial movement (steps 402, 502). Initially, the tool component coated or wrapped with the flexible carrier material 301 may be characterized as having a first degree of movement, namely only having limited or no movement, with the flexible carrier material 301 being in a first state where little or no force has been applied to the flexible carrier material 301. In other words, the tool component may be limited to movement of only a first distance or angle. Thus, the first degree of movement is limited by the presence of collapsible objects 305 carried by a flexible carrier material 301 deployed on the moveable tool component. The tool component may then be positioned in a wellbore at a desired location (steps 404, 504) where movement of the tool component may be constrained by the collapsible objects 305 and/or cement installed around the tool 102, 200 (steps 406, 506). Thereafter, a force may be applied to the tool component (steps 408, 508). The force results in crushing or collapsing of the collapsible objects 305, so as to reduce the volume of the collapsible objects 305 (step 410, 510). In some preferred embodiments, the volume reduction may be permanent, such as would be the case if the collapsible objects 305 are glass spheres that are broken upon crushing or the collapsible objects 305 are plastically deformable. Upon reduction of the volume of the collapsible objects 305 upon crushing or collapsing, the space available for movement of the tool component is increased, allowing a second degree of movement greater than the first degree of movement. In other words, the movement of the tool component is increased to second distance or angle that is greater than the first distance or angle. During operation, it may be necessary to apply compressive force to the flexible material over a number of cycles in order to crush or collapse a sufficient amount of collapsible objects 305 in order to achieve the desired degree of movement for the tool component. For example, a flexible carrier material 301 may be applied to the housing of a barrier valve tool. In the case of a barrier valve tool, as explained above, a portion of the barrier valve tool can be flexed in order to operate the tool (step 412, 512), and as such, is movable.

A radially outward force may be applied to a portion of the tool body in order to flex the tool body, resulting in compression of the flexible material disposed around the tool body. Compression of the flexible material results in crushing or collapsing of the objects carried by the flexible material disposed about the tool body. As the objects are collapsed or crushed, the available space through which the tool body may move or "flex" is increased. The force may be applied with a pressurized fluid within the tool body. The fluid pressure may be increased and decreased for several cycles in order to crush or collapse a sufficient amount of objects to achieve a desired amount of flexure of the tool body.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

Thus a downhole tool has been described. The downhole tool may include a barrier valve having an elongated body with an interior and exterior surface; an elastomeric material applied along at least a portion of the length of the elongated body. In other embodiments, the downhole tool may include a barrier valve having an elongated housing with an interior and exterior surface, the housing further having a flexible portion bounded by rigid portions, the flexible portion disposed for movement under application of a force; and a flexible carrier material applied to the flexible portion of the tool, wherein the flexible carrier material comprises crushable hollow objects carried by the carrier material. In yet other embodiments, the downhole tool may include a tool body and at least one tool component carried by the tool body, wherein a flexible portion of the tool component is disposed for movement under application of a force; and a flexible carrier material applied to flexible portion of the tool, wherein the flexible carrier material comprises crushable hollow objects carried by the carrier material. In yet another embodiment, the downhole tool may include an elongated body with an interior and exterior surface; an elastomeric material applied along at least a portion of the length of the elongated body, wherein the elongated body includes a portion disposed for flexing under application of radial force, wherein the elastomeric material is disposed about the portion, the elastomeric material including a multiplicity of hollow objects that may be permanently collapsed or crushed upon application of a force. In yet other embodiments, the downhole tool may include a housing; an actuator sleeve in the housing, the actuator sleeve having an internal shifting tool engaging profile; an actuator in the housing, the actuator responsive to a remote signal to change from an unactuated state to an actuated state and shift the actuator sleeve from a first position to a second position; a collet ring in the housing that comprises a plurality of collet fingers, the collet fingers supported to couple the actuator sleeve to the actuator while the actuator changes from the unactuated state to the actuated state and unsupported to allow the actuator sleeve to move relative to the actuator when the actuator is in the actuated state, the collet fingers supported in an axially elongate profile of the actuator sleeve while the actuator changes from the unactuated state to the actuated state, and an end of the axially elongate profile abuts the collet fingers and transfer loads from the actuator, through the collet fingers, to the actuator sleeve as the actuator changes from the unactuated state to the actuated state;

a tubular support body moveable between supporting the collet fingers engaged in the axially elongate profile and not supporting the collet fingers engaged in the axially elongate profile; and a flexible carrier material disposed about at least a portion of the housing and crushable hollow objects carried by the flexible carrier material.

For any one of the forgoing embodiments, one or more of the following elements may be included, alone or in combination with other elements:

The downhole tool is a fluid loss barrier valve.

The elongated body includes a portion disposed for flexing under application of radial force, wherein the elastomeric material is disposed about the portion.

The elastomeric material includes hollow glass spheres.

The glass spheres are embedded in the elastomeric material.

The elastomeric material is rubber.

The elastomeric material includes hollow glass spheres.

The glass spheres are embedded in the elastomeric material.

The crushable hollow objects are glass spheres.

The crushable hollow objects are glass.

The crushable hollow objects are plastic.

The crushable hollow objects include at least one fluid therein that when exposed to the carrier material will interact with the carrier material to degrade the carrier material.

The carrier material is selected of the group consisting of rubber, open cell foam, a swellable material, a woven material and fabric.

The crushable hollow objects are embedded in the carrier material.

The tool component is an elongated tool body having an interior and exterior, and the flexible portion of the tool body is bounded by rigid portions.

The tool is a barrier valve having an elongated body with an interior and exterior surface.

The crushable hollow object comprises a fluid disposed within an interior of the object.

The fluid is a gas disposed to react with the carrier material.

The fluid is a liquid disposed to react with the carrier material.

The flexible carrier material is a sheet at least partially wrapped around the tool component.

An actuator sleeve in the housing, the actuator sleeve having an internal shifting tool engaging profile; an actuator in the housing, the actuator responsive to a remote signal to change from an unactuated state to an actuated state and shift the actuator sleeve from a first position to a second position; a collet ring in the housing that comprises a plurality of collet fingers, the collet fingers supported to couple the actuator sleeve to the actuator while the actuator changes from the unactuated state to the actuated state and unsupported to allow the actuator sleeve to move relative to the actuator when the actuator is in the actuated state, the col let fingers supported in an axially elongate profile of the actuator sleeve while the actuator changes from the unactuated state to the actuated state, and an end of the axially elongate profile abuts the collet fingers and transfer loads from the actuator, through the collet fingers, to the actuator sleeve as the actuator changes from the unactuated state to the actuated state; a tubular support body moveable between supporting the collet fingers engaged in the axially elongate profile and not supporting the collet fingers engaged in the axially elongate profile.

The flexible carrier material is a sheet at least partially wrapped around the tool component.

The objects are plastically deformable.

The objects are permanently deformable.

Thus, a method of operating a downhole tool has been described and may include the steps of deploying a downhole tool having a moveable tool component in a wellbore, wherein the moveable component is constrained to a first degree of movement; applying a force to the movable tool component; utilizing the applied force to crush or collapse objects carried by a flexible material disposed on the moveable tool component, thereby increasing the degree of movement of a moveable component to a second degree of movement greater than the first degree of movement. In other embodiments, the method may include deploying a downhole tool having a moveable tool component in a wellbore, wherein the moveable component is constrained to a first state of movement; applying a force to the movable tool component; utilizing the applied force to crush or collapse objects carried by a flexible material disposed on the moveable tool component, thereby increasing the degree of movement of a moveable component to a second state of movement greater than the first state of movement. In certain embodiments, the method may include operating a barrier valve tool by deploying the barrier valve tool in a wellbore; cementing the barrier valve tool into the wellbore, thereby constraining radial movement of the tool's housing to a first degree of movement; utilizing a working fluid within housing to apply a radial force to the housing; utilizing the radial force to crush or collapse objects carried by a flexible material disposed on the exterior of the housing, thereby increasing the degree of movement of a moveable component to a second degree of movement greater than the first degree of movement; thereafter, flexing the housing through the second degree of movement in order to operate the valve tool. In certain embodiments, the method may include utilizing a plurality or multiplicity of crushable hollow objects to constrain movement of a component of the deployed tool to a first degree of movement; utilizing a working fluid to apply a force to tool the component; utilizing the applied force to crush or collapse the hollow objects constraining movement of the component, thereby increasing the degree of movement of the moveable component to a second degree of movement greater than the first degree of movement; and moving the tool component through the second degree of movement in order to operate the tool.

For any one of the foregoing methods, one or more of the following steps may be performed, alone or in combination with other steps:

A force is applied and reduced through a number of cycles to gradually increase the degree of movement of the moveable component.

A force is applied and reduced through a number of cycles to gradually increase the degree of movement of the moveable component from the first state of movement to the second state of movement.

The first degree of movement is limited by the presence of collapsible objects carried by a flexible carrier material deployed on the moveable component, and wherein the volume of a multiplicity of crushable or collapsible objects is decreased upon application of the force.

Breaking the objects by crushing.

Plastically deforming the objects by crushing.

A force is applied and reduced through a number of cycles to gradually increase the degree of movement of the moveable component.

The first degree of movement is limited by the presence of collapsible objects carried by a flexible carrier material deployed on the moveable component, and wherein the volume of a multiplicity of crushable or collapsible objects is decreased upon application of the force.

A number of examples have been described. Nevertheless, it will be understood that various modifications may be made. Accordingly, other examples are within the scope of the following claims.

What is claimed is:

1. A downhole tool, comprising:

an elongated housing defining an interior central bore and a flexible portion bounded by rigid portions, the flexible portion disposed for radial movement with respect to the rigid portions under an application of a force within the interior central bore;

a carrier material applied to the flexible portion of the housing, and a plurality of collapsible objects carried by the carrier material, wherein a degree of radial movement of the flexible portion is limited by the carrier material when the collapsible objects are in a first uncollapsed state and the degree of movement of the flexible portion is increased when the collapsible objects are in a second collapsed state; and wherein the collapsible objects are hollow and selected from the group consisting of glass spheres, plastic spheres, glass shapes and plastic shapes.

2. The downhole tool of claim 1, wherein the collapsible objects include at least one fluid therein that when exposed to the carrier material will interact with the carrier material to degrade the carrier material.

3. The downhole tool of claim 1, wherein the carrier material is constructed of a flexible sheet at least partially wrapped around the flexible portion of the housing.

4. The downhole tool of claim 3, wherein the flexible sheet of carrier material is selected from the group consisting of rubber, open cell foam, a swellable material, a woven material, fabric, resin, epoxy, plastic, thermoplastic, polyester, silicone and foamed cement.

5. The downhole tool of claim 1, further comprising an actuator assembly disposed within the flexible portion of the elongated housing, the actuator assembly operable to move a tool element between unactuated and actuated configurations when the flexible portion is displaced from the rigid portions under the application of the force within the interior central bore.

6. The down hole tool of claim 5, wherein the tool element is a valve closure for a barrier valve, wherein the valve closure selectively permits and prohibits flow through the interior central bore.

7. A downhole tool system, comprising:

a completion string extending into a wellbore from a terranean surface;

a downhole tool component coupled to the completion string and including a flexible portion radially movable between radially contracted and expanded configurations, wherein the flexible portion of the downhole tool component is constrained by cement within the wellbore;

an actuator assembly disposed within the flexible portion of the downhole tool component and operable to move between an unactuated configuration when the flexible portion is in the radially contracted configuration and an actuated configuration when the flexible portion is in the radially expanded configuration;

a carrier material applied to the flexible portion of the downhole tool component, and a plurality of collapsible objects carried by the carrier material.

8. The downhole tool system of claim 7, wherein the tool component comprises an elongate housing defining a central bore fluidly coupled to the completion string, and wherein the flexible portion of the elongate housing is radially movable between radially contracted and expanded configurations by application of hydraulic pressure to the central bore through the completion string.

9. The downhole tool system of claim 8, wherein the flexible portion of the elongate housing is bounded by rigid portions of the elongate housing, and wherein the carrier material extends at least partially over the rigid portions and forms a seal between the rigid portions and the cement.

10. The downhole tool system of claim 8, wherein the actuator assembly is operably coupled to a valve closure for a barrier valve, wherein the valve closure selectively permits and prohibits flow through the interior central bore.

11. The downhole tool system of claim 7, wherein the collapsible objects are crushable such that the collapsible objects may be permanently collapsed or crushed upon application of a force.

12. A method of operating a downhole tool comprising:

deploying a downhole tool component having a flexible portion into a wellbore with the flexible portion constrained to a first range of movement;

applying a force to the flexible portion of the downhole tool component within the wellbore to collapse collapsible objects carried by of flexible carrier material disposed on the flexible portion of the downhole tool component, thereby increasing a degree of movement of the flexible portion of the downhole tool component to a second range of movement greater than the first range of movement; and actuate a downhole tool element operably coupled to the flexible portion of the downhole tool component by moving the flexible portion of the downhole tool component through the second range of movement.

13. The method of claim 12, further comprising cementing the flexible portion of the downhole tool component in place in the wellbore prior to applying the force to the flexible portion of the downhole tool component.

14. The method of claim 12, further comprising pumping a working fluid through a central bore defined through the downhole tool component to thereby apply the force to the flexible portion of the downhole tool component.

15. The method of claim 14, wherein pumping the working fluid includes increasing and decreasing a hydraulic pressure of the working fluid within the downhole tool component in a plurality of cycles to gradually increase the degree of movement of the flexible portion of the downhole tool component.

16. The method of claim 12, further comprising permanently reducing a volume of the collapsible objects by applying the force to the flexible portion to break or plastically deform the collapsible objects.

17. The method of claim 12, further comprising mechanically engaging a profile within the downhole tool to actuate the downhole tool element either prior to or subsequent to actuating the downhole tool element by moving the flexible portion of the downhole tool component through the second range of movement.

18. A down hole tool, comprising:

an elongated housing defining an interior central bore and a flexible portion bounded by rigid portions, the flexible portion disposed for radial movement with respect to the rigid portions under an application of a force within the interior central bore;

a carrier material applied to the flexible portion of the housing;

a plurality of collapsible objects carried by the carrier material; and an actuator assembly disposed within the flexible portion of the elongated housing, the actuator assembly operable to move a tool element between unactuated and actuated configurations when the flexible portion is displaced from the rigid portions under the application of the force within the interior central bore, wherein the tool element is a valve closure for a barrier valve, wherein the valve closure selectively permits and prohibits flow through the interior central bore.

19. The downhole tool of claim 18, wherein a degree of radial movement of the flexible portion is limited by the carrier material when the collapsible objects are in a first uncollapsed state and the degree of movement of the flexible portion is increased when the collapsible objects are in a second collapsed state.

20. The downhole tool of claim 19, wherein the collapsible objects are hollow and selected from the group consisting of glass spheres, plastic spheres, glass shapes and plastic shapes.

* * * * *